United States Patent [19]

Umezaki

[11] Patent Number: 4,982,498

[45] Date of Patent: Jan. 8, 1991

[54] METHOD OF MAKING A HIGH-VOLTAGE TRANSFORMER

[75] Inventor: Tomokazu Umezaki, Himeji, Japan

[73] Assignee: Mitsubishi Denki Kabushiki Kaisha, Japan

[21] Appl. No.: 439,192

[22] Filed: Nov. 20, 1989

Related U.S. Application Data

[62] Division of Ser. No. 128,418, Dec. 3, 1987.

[51] Int. Cl.[5] ..... H01F 7/06

[52] U.S. Cl. ..... 29/602.1; 29/856; 264/272.19

[58] Field of Search ..... 29/602.1, 854, 855, 29/856; 264/272.19; 336/105, 107, 192, 205, 96

[56] References Cited

U.S. PATENT DOCUMENTS

| | | | |
|---|---|---|---|
| 3,141,923 | 7/1964 | Henschke et al. | 174/59 |
| 3,566,465 | 3/1971 | Weiner | 29/602.1 |
| 3,905,001 | 9/1975 | Sato et al. | 336/94 |
| 3,909,759 | 9/1975 | Ouellette et al. | 336/84 |
| 4,109,224 | 8/1978 | Liautaud | 264/272.19 |
| 4,232,284 | 11/1980 | Phelon et al. | 336/90 |
| 4,406,271 | 9/1983 | Wolf | 123/599 |
| 4,516,559 | 5/1985 | Oohashi | 123/634 |
| 4,734,055 | 3/1988 | Misu | 29/854 |

*Primary Examiner*—P. W. Echols

*Attorney, Agent, or Firm*—Leydig, Voit & Mayer

[57] ABSTRACT

A high-voltage transformer is provided which includes a primary coil and a secondary coil disposed in a coil case, and a support member attached to the coil case and having a high-voltage terminal for electrically connecting a lead wire of the secondary coil with an external electrical device. The primary and secondary coil are first accommodated in the coil case, and the lead wire of the secondary coil is temporarily connected with the high-voltage terminal while the support member is separated from the coil case and freely moved to an appropriate location. Then, the lead wire of the secondary coil thus temporarily connected is soldered to the high-voltage terminal. Thereafter, the support member having the high-voltage terminal thus soldered to the secondary coil lead wire is attached to the coil case. Finally, a resin is filled into the coil case so as to firmly secure the primary and secondary coils and the support member to the coil case.

12 Claims, 3 Drawing Sheets

METHOD OF MAKING A HIGH-VOLTAGE TRANSFORMER

This application is a divisional of application Ser. No. 128,418, filed Dec. 3, 1987.

BACKGROUND OF THE INVENTION

1. Field of the Invention

This invention relates to a high-voltage transformer such as an ignition coil for internal combustion engines, and more particularly, to a connecting arrangement for connecting a coil with an output terminal. This invention is also concerned with a method for making a high-voltage transformer.

2. Description of the Prior Art

FIG. 1 is a plan view showing a conventional high-voltage transformer for internal combustion engines, and FIG. 2 is a cross sectional view taken along line II—II of FIG. 1. In these figures, the high-voltage transformer 1 in the form of an ignition coil comprises a generally cylindrical coil case 2 formed of a synthetic resin, a primary coil 3 in the coil case 2, a secondary coil 4 disposed in the coil case 2 so as to surround the primary coil 3, a cylindrical sleeve 5 disposed in and fixedly mounted on the coil case 2 substantially at the center thereof for receiving a rotary shaft 8 of a distributor (not shown), and an iron core 6 disposed in the coil case 2 around the sleeve 5 so as to surround the primary coil 3 and the secondary coil 4.

The iron core 6 comprises an annular inner or central leg portion 601 disposed around the cylindrical sleeve 5 and radially inside the primary coil 3, four planar outer leg portions 602 disposed radially outside the secondary coil 4, a pair of first (or lower) and second (or upper) cross-shaped arm portions 603 and 604 interconnecting the inner and outer leg portions 601 and 602 for forming a closed magnetic path which passes through the primary and secondary coils 3, 4 when these coils are energized.

A resin 7 is filled into the coil case 2 and impregnated into the spaces between the coils 3, 4 and the iron core 6 for electrically insulating the coils 3, 4 and the iron core 6 from each other as well as for firmly securing or bonding them to the coil case 2. In this case, the lower arm portion 603 of the iron core 6 is molded integrally with or firmly connected by other appropriate fastening or bonding means with the coil case 2, and it is exposed to the outside of the coil case 2 for dissipating heat which is generated during molding of the coil case 2 or the like.

A high-voltage terminal 9 is integrally mounted as by molding on the coil case 2 on its one side for taking out the high-voltage output of the secondary coil 4. The terminal 9 is electrically connected at one end with a lead wire or output end 4a of the secondary coil 4 and at other end with an external electrical device such as, for example, a central electrode of a distributor cap (not shown), which is attached to the center of a distributor rotor (not shown) mounted on the rotary shaft 8 for integral rotation therewith.

With the conventional high-voltage transformer 1 as constructed above, the high-voltage terminal 9 is integrally molded with the coil case 2 at the time when the coil case 2 is molded from a synthetic resin. Assembly of the entire transformer 1 is effected as follows. First, the iron core 6, the primary coil 3 and the secondary coil 4 are disposed in positions in the coil case 2. In this state, the output end or lead wire 4a of the secondary coil 4 is soldered to the high-voltage terminal 9. Thereafter, a molten resin 7 is filled into the coil case 2, impregnated inbetween the above members in the coil case 2, and solidified to firmly install or secure them to the coil case 2.

In the above assembly processes of the conventional transformer 1, however, the terminal 9 is firmly connected as by molding with the coil case 2 before the resin 7 is filled into the coil case 2. Accordingly, one must connect or solder the output end or lead wire 4a of the secondary coil 4 to the high-voltage terminal 9, which is fixed to the coil case 2 and can not be moved freely, at a location within the coil case 2 which has a relatively narrow working space. In fact, it is very difficult and inefficient to carry out such connection or soldering by passing the secondary coil lead wire 4a through a small aperture which is formed at one end of the terminal 9 even if the secondary coil lead wire 4a is made very close to the terminal lead wire 9a. Moreover, there arises another problem in that it is difficult to prevent the secondary coil lead wire 4a from sagging so as to ensure good and reliable soldering.

SUMMARY OF THE INVENTION

The present invention is intended to obviate the above-described problems of the prior art, and has for its object the provision of a high-voltage transformer and a method of making the same in which the output end or lead wire of a coil can be reliably soldered to a high-voltage terminal with extreme ease and efficiency.

In order to achieve the above object, according to one aspect of the present invention, there is provided a high-voltage transformer which comprises:

a coil case;

a primary coil disposed around the iron core in the coil case;

a secondary coil disposed around the primary coil and having a lead wire;

a support member formed separately from the coil case and having a high-voltage terminal, the lead wire of the secondary coil being temporarily connected and subsequently soldered to the high-voltage terminal while the support member is separate from the coil case and freely movable to an appropriate location, the support member being attached to the coil case after the secondary coil lead wire has been thus soldered to the terminal; and a resin filled into the coil case for firmly securing the primary and secondary coils and the support member to the coil case.

According to another aspect of the present invention, there is provided a method for making a high-voltage transformer which includes a primary coil and a secondary coil disposed in a coil case, and a support member attached to the coil case and having a high-voltage terminal for electrically connecting a lead wire of the secondary coil with an external electrical device, the method comprising the following steps of:

accommodating the primary and secondary coil in the coil case;

temporarily connecting the lead wire of the secondary coil with the high-voltage terminal while the support member is separate from the coil case and freely movable to an appropriate location;

soldering the temporarily connected the lead wire of the secondary coil to the high-voltage terminal;

attaching the support member to the coil case; and filling a resin in the coil case so as to firmly secure the primary and secondary coils and the support member to the coil case.

In the present invention, since the high-voltage terminal is free to move together with the support member during soldering of the secondary coil lead wire, a worker can take the terminal along with the support member by hand and temporarily connect the secondary coil lead wire with the terminal, and then solder them without difficulty. Such temporary connection and soldering can be easily carried out at an appropriate location inside or outside the coil case without any substantial restraints on the working space. This serves to materially improve the efficiency and reliability of such operations.

The above and other objects, features and advantages of the present invention will be more readily apparent from the following detailed description of a few preferred embodiments thereof when taken in conjunction with the accompanying drawings.

DESCRIPTION OF THE PREFERRED EMBODIMENTS

Figure 1:
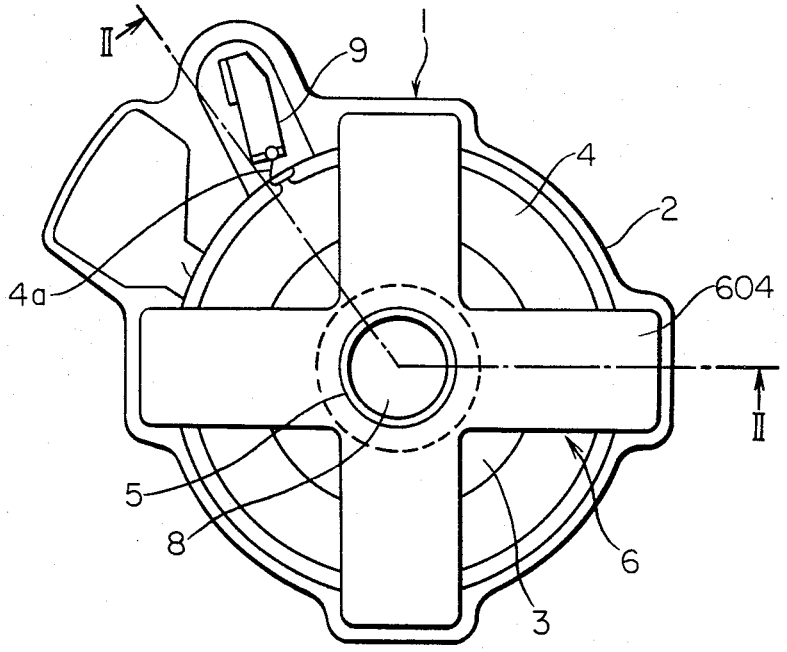
FIG. 1 PRIOR ART
FIG. 1 is a plan view showing a conventional high-voltage transformer for internal combustion engines.
Figure 2:
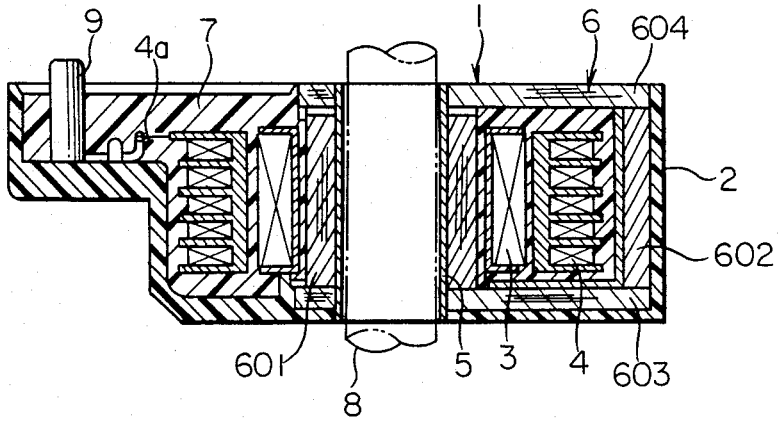
FIG. 2 PRIOR ART
FIG. 2 is a cross sectional view taken on line II—II of FIG. 1.

The present invention will now be described in detail with reference to a few presently preferred embodiments thereof as illustrated in the accompanying drawings. In the following description and the figures of the accompanying drawings, the same reference numerals as those employed in FIGS. 1 and 2 designate the same or corresponding parts or members.

Figure 3:
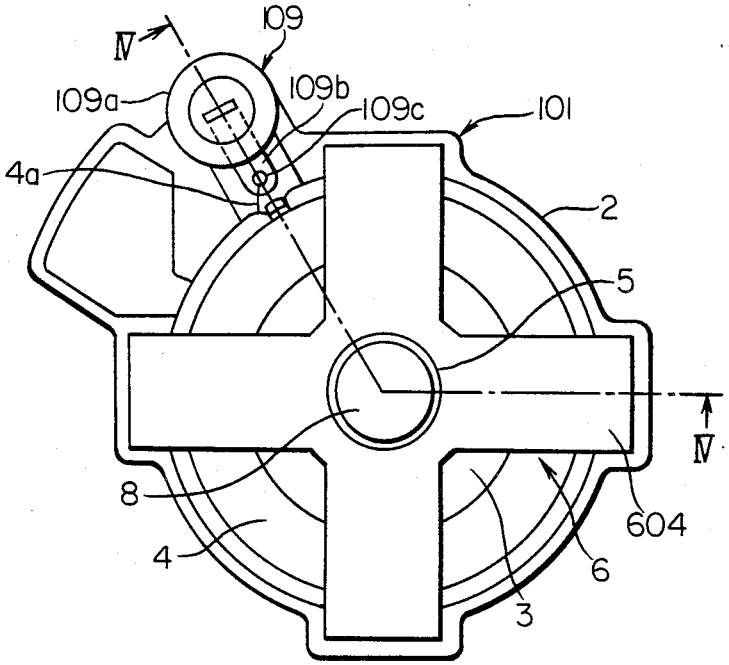
FIG. 3 is a plan view of a high-voltage transformer with a high-voltage terminal in accordance with one embodiment of the present invention.
Figure 4:
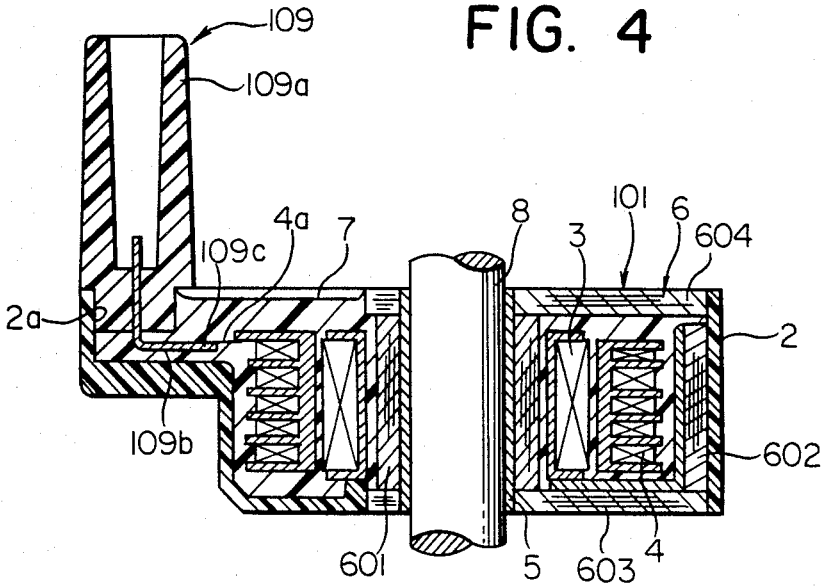
FIG. 4 is a cross sectional view taken on line IV—IV of FIG. 3.

Referring first to FIGS. 3 and 4, there is shown a high-voltage transformer 101 having a high-voltage terminal assembly 109 which is constructed in accordance with one embodiment of the present invention. The high-voltage transformer 101 in the form of an ignition coil for internal combustion engines of this embodiment is substantially similar to the conventional transformer 1 illustrated in FIGS. 1 and 2 except for the following. Specifically, the high-voltage terminal assembly 109 comprises a generally cylindrical support member **109*a* which is molded from a synthetic resin and which has its bottom end closed, and a high-voltage terminal 109*b* which is formed of an L-shaped terminal plate and which extends through and fixedly supported by the bottom end of support member 109*a* for electrical connection at one end with the output end or lead wire 4*a* of the secondary coil 4 and at the other end with an external electrical device such as a central electrode of a distributor cap (not shown). The support member 109*a* is fabricated separately from a coil case 2 and fixedly mounted or attached as by press fitting to the coil case 2 on its one side after the output end or lead wire 4*a* of a secondary coil 4 has been electrically connected by soldering with the high-voltage terminal 109*b* of the high-voltage terminal assembly 109. The L-shaped high-voltage terminal 109*b* has a small hole or aperture 109*c* formed therethrough at its one end extending outwardly from the support member 109*a* for passage of the lead wire 4*a* of the secondary coil 4**.

In the high voltage transformer 101 of this embodiment, the output end or lead wire **4*a* of the secondary coil 4 is soldered to the outwardly extended end of the high-voltage terminal 109*b* in the following manner. At first, the high-voltage terminal assembly 109, fabricated separately from the coil case 2, is taken by one hand of a worker, and by using the other hand, the tip end of the relatively long lead wire 4*a* of the secondary coil 4 is passed or inserted through the small aperture 109*c* of the high-voltage terminal 109*b* and, if necessary, wound around the extended end of the terminal 109*b* for temporary connection. In this connection, such temporary connection can be made in an appropriate location inside or outside the coil case 2 as required for improving the working efficiency. Then, the support member 109*a* is press fitted into a mounting hole 2*a* which is formed in the coil case 2 on its one side, as clearly shown in FIG. 4. Subsequently, the lead wire 4*a* of the secondary coil 4 is soldered to the extended end of the terminal 109*b* while being pulled for removal of any slack or sagging thereof, and the surplus or unnecessary portion of the lead wire 4*a* is removed by cutting. In this manner, the soldering can be performed easily and reliably. Thereafter, a molten resin 7 is filled into the coil case 2, impregnated inbetween these members in the coil case 2 and solidified to firmly secure them to the coil case 2**.

In this manner, the high-voltage terminal assembly 109, which is fabricated separately from the coil case 2 and can be moved to an appropriate location, serves to practically facilitate the temporary connection and subsequent soldering of the secondary coil lead wire **4*a* to the high-voltage terminal 109*b***.

Figure 5A:
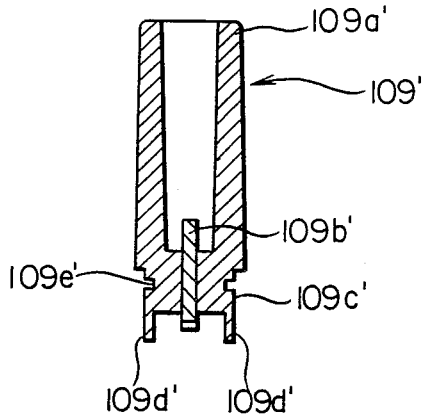
FIG. 5A is a vertical sectional view of a high-voltage terminal in accordance with another embodiment of the present invention.
Figure 5B:
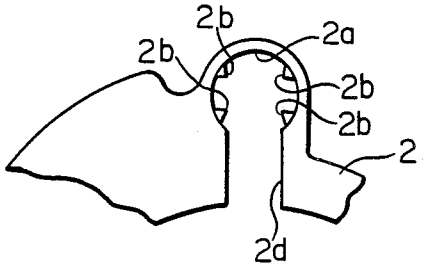
FIG. 5B is a plan view showing a portion of a coil case on which the terminal of FIG. 5A is to be mounted.

FIGS. 5A and 5B show a high-voltage terminal assembly 109' along with a portion of a coil case 2 on which the terminal assembly is to be mounted in accordance with another embodiment of the present invention. In this embodiment, the terminal assembly 109' comprises a generally cylindrical hollow support member **109*a'* comprises a generally cylindrical hollow support member 109*a'* and a generally L-shaped high-voltage terminal 109*b* attached to the bottom end of the support member 109*a'*, the support member 109*a'* having a unique mounting structure which is different from that of the support member 109*a* illustrated in FIGS. 3 and 4**.

Specifically, as clearly seen from FIG. 5A, the cylindrical support member **109*a'* has at its bottom end a reduced-diameter mounting portion 109*c'* which is smaller in diameter than the remaining cylindrical portion and which is adapted to be press fitted into a generally circular vertically extending mounting hole 2*a* formed in the coil case 2 on one side thereof. The cylindrical side wall of the mounting hole 2*a* has a plurality of pairs of (two pairs in the illustrated embodiment) support ribs 2*b* which extend vertically along and are spaced circumferentially along the cylindrical inner surface of the mounting hole 2*a*. The mounting portion 109*c'* of the support member 109*a'* is integrally formed with plural (two in the illustrated embodiment) legs 109*d'* which extend vertically from the end thereof and which, when the support member 109*a'*** is being mounted on the coil case 2, are guided along and fitted between the corresponding pair of parallel extending adjacent support ribs 2*b* so as to fixedly mount the support member 109′ on the coil case 2 against any circumferential movement. In this case, the cylindrical peripheral surface of the support member mounting portion 109*c*′ is resiliently or frictionally engaged with the inner wall surface of the mounting hole 2*a* in the coil case 2 so as to provide further rigid support or mounting of the support member 109*a*′ on the coil case 2.

After the support member 109*a*′ is press fitted into the mounting hole 2*a* in the coil case 2, a portion of a molten resin 7, which is filled into the coil case 2, flows into the mounting hole 2*a* through a communication passage 2*d* and is solidified to firmly bond the support member 109*a*′ to the coil case 2. In this case, however, it is generally difficult to supply the molten resin 7 to a space between the cylindrical outer surface of the support member mounting portion 109*c*′ and the inner wall surface of the mounting hole 2*a*, as a consequence of which a creeping leakage of high voltage will be apt to arise along the engaged surfaces of the support member 109*a*′ and the coil case 2. But in this embodiment, the molten resin 7 can be supplied and filled into the interstices between the engaged surface through an annular groove 109*e*′ on the outer surface of the support member mounting portion 109*c*′ so that such a creeping leakage is positively prevented.

What is claimed is:

1. A method for making a high-voltage transformer which includes a primary coil and a secondary coil disposed in a coil case, and a support member attached to said coil case and having a high-voltage terminal for electrically connecting a lead wire of said secondary coil with an external electrical device, said method comprising the steps of:

accommodating said primary and secondary coil in said coil case;

temporarily connecting the lead wire of said secondary coil with said high-voltage terminal while said support member is separate from said coil case and freely movable to an appropriate location;

soldering the temporarily connected lead wire of said secondary coil to said high-voltage terminal;

attaching said support member to said coil case; and filling a resin in said coil case so as to firmly secure said primary and secondary coils and said support member to said coil case.

2. A method of making a high-voltage transformer as claimed in claim 1, wherein in said temporarily connecting step, the lead wire of said secondary coil is inserted into a small aperture in said high-voltage terminal for temporary connection therewith, and any slack in the lead wire of said secondary coil thus inserted is removed before said lead wire is soldered to said high-voltage terminal.

3. A method of making a high-voltage transformer as claimed in claim 1, wherein in said support member attaching step, said support member is press fitted into a mounting hole in said coil case.

4. A process for producing a high-voltage transformer comprising:

disposing a primary coil around an iron core in a coil case;

disposing around said primary coil a secondary coil having a lead wire;

separately forming a high voltage terminal assembly, said high voltage terminal assembly having a support member and a high-voltage terminal;

connecting said lead wire of said secondary coil to said high-voltage terminal while said support member is separate from said coil case;

attaching said support member to a portion of said coil case; and securing said primary and secondary coils and said support member to said coil case by filling said coil case with a resin.

5. The process according to claim 4 wherein said high-voltage terminal is formed atone end with a small aperture into which said lead wire of said secondary coil is inserted.

6. The processof claim 5 wherein said lead wire is soldered to said terminal.

7. The process according to claim 4 wherein said support member has a reduced-diameter mounting portion member which is provided on its outer peripheral surface with an annular groove for guiding said resin into interstices between the engaged surfaces of said support member mounting portion.

8. The process of claim 4 wherein said portion has a mounting hole.

9. The process of claim 4 wherein said support member has a mounting portion adapted to be inserted into a mounting hole in said portion on said coil case.

10. A process for producing a high-voltage transformer comprising:

disposing a primary coil around an iron core in a coil case;

disposing around said primary coil a second coil having a lead wire;

forming a high voltage terminal assembly separate from said coil case, said terminal assembly having a support member and a high-voltage terminal;

temporarily connecting said lead wire of said secondary coil to said high-voltage terminal while said support member is separate from said coil case and subsequently soldering said lead wire of said secondary coil to said high-voltage terminal;

attaching said support member to a portion of said coil case; and securing said primary and secondary coils and said support member to said coil case by filling said coil case with a resin.

11. The process according to claim 10 wherein said support member has a reduced-diameter mounting portion which is provided on its outer peripheral surface with an annular groove for guiding said resin into interstices between the engaged surfaces of said support member mounting portion.

12. The process according to claim 11 wherein said mounting portion is press fitted into a mounting hole in said coil case, and said mounting hole has a plurality of support ribs adapted to engage said mounting portion.

* * * * *